United States Patent [19]

Dehli et al.

[11] Patent Number: 4,815,523

[45] Date of Patent: Mar. 28, 1989

[54] DEVICE AND PROCESS FOR CLEANING A RECIRCULATION-TYPE REGENERATIVE HEAT EXCHANGER

[75] Inventors: Frank Dehli, Heidelberg; Fritz Lampl, Wien-Neudorf, both of Fed. Rep. of Germany

[73] Assignee: Kraftanlagen AG, Heidelberg, Fed. Rep. of Germany

[21] Appl. No.: 5,197

[22] PCT Filed: Nov. 9, 1985

[86] PCT No.: PCT/EP85/00599

§ 371 Date: Dec. 29, 1986

§ 102(e) Date: Dec. 29, 1986

[87] PCT Pub. No.: WO86/06464

PCT Pub. Date: Nov. 6, 1986

[30] Foreign Application Priority Data

Apr. 26, 1985 [JP] Japan ..... 60-89143

[51] Int. Cl.[4] ..... F28G 9/00

[52] U.S. Cl. ..... 165/5; 134/181; 134/102; 134/167 R

[58] Field of Search ..... 165/5; 134/181, 102, 134/167 R

[56] References Cited

U.S. PATENT DOCUMENTS

| | | | |
|---|---|---|---|
| 2,236,635 | 4/1941 | Young et al. | 165/5 |
| 2,761,653 | 9/1956 | Grames et al. | 165/5 |
| 4,025,362 | 5/1977 | Frauenfeld | 165/5 |
| 4,256,511 | 3/1981 | Atchison et al. | 134/181 |
| 4,376,443 | 3/1983 | Mondy, Jr. | 134/181 |
| 4,402,104 | 9/1983 | Olesousky et al. | 134/181 |

FOREIGN PATENT DOCUMENTS

| | | | |
|---|---|---|---|
| 789971 | 1/1958 | United Kingdom | 165/5 |

*Primary Examiner*—Albert W. Davis, Jr.

[57] ABSTRACT

A process and device for cleaning a rotary regenerative heat exchanger with a rotating part and a storage mass, for the transfer of heat from a higher-temperature, contaminated gas stream to a lower-temperature clean gas stream, in which upon reduction of the rotatory speed of the rotating part, jets of a cleaning agent and, immediately thereafter, jets of a gaseous drying agent, are sprayed onto the storage mass, with a continuous or step-wise radial displacement of the jets from the circumference to the center of the rotating mass and vice versa. The device includes a carriage, which is guided and driven radially over the storage mass. At least one nozzle each for a cleaning agent and a drying agent are on the carriage. A drive is associated with the rotor for establishing variable running speeds and lower cleaning speeds and for varying the rotatory speed of the rotor depending on the position of the carriage between the center and the circumference. A receptacle is arranged directly adjacent the storage mass remote from the nozzles, for catching and carrying away the cleaning agent including impurities removed from the storage mass.

14 Claims, 1 Drawing Sheet

DEVICE AND PROCESS FOR CLEANING A RECIRCULATION-TYPE REGENERATIVE HEAT EXCHANGER

Figure 1:
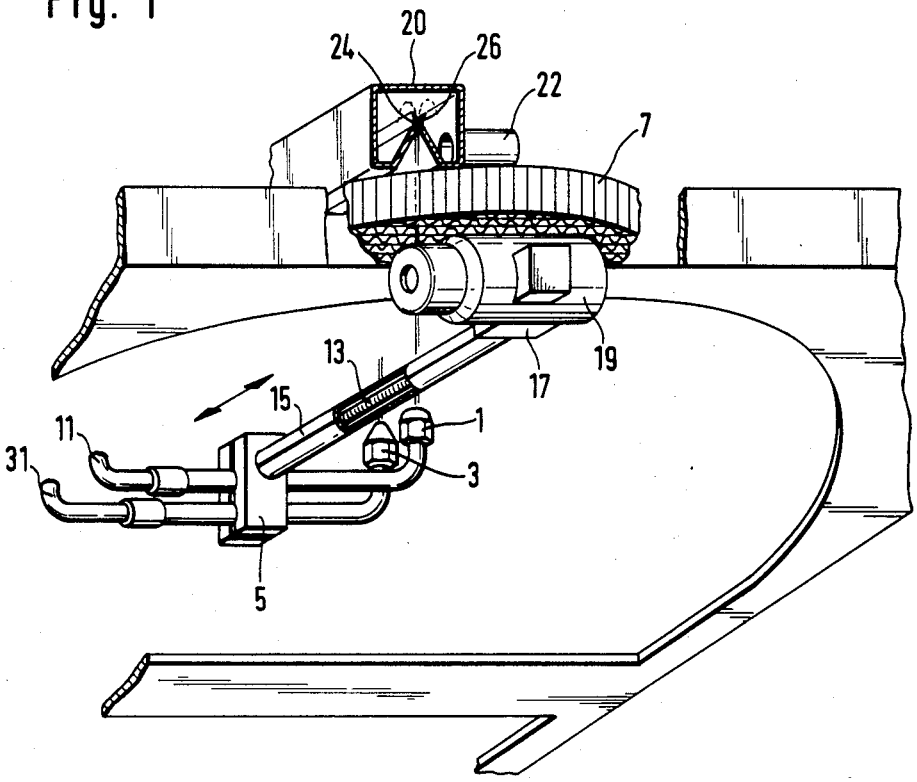

The invention relates to a device for cleaning rotary regenerative heat exchangers for the transfer of heat from a higher-temperature contaminated gas stream to a lower-temperature stream of clean gas. The device has nozzles disposed on a carriage, as well as a guide and a drive for the radial displacement of the carriage over the face(s) of the storage mass of the recirculating regenerative heat exchanger between an outer circumferential end position and an inner end position nearer to the hub, and flexible conduits for carrying the cleaning and/or rinsing media to the nozzles, and to a process for cleaning rotary regenerative heat exchangers.

In connection with rotary regenerative heat exchangers in boilers for the transfer of the exhaust heat to the fresh air being fed to the combustion device, the media, hot steam and compressed air, which are available in the generating plant, are often used as cleaning agents in cleaning apparatus, for the purpose of removing aqueous precipitates at the so-called cold end of these heat exchangers. As a rule, the cleaning is limited to this cold end, at which the cooled gases leave and the combustion air enters, after the temperature on this side of the heat transfer surfaces temporarily falls below the dewpoint and thus the formation of incrustations is favored. By cleaning at the exhaust end, the passage of the loosened incrustations through the fresh air line and its throttle valves into the burners of the boiler, which might impair their operation, is avoided.

In order to clean severely contaminated and encrusted heating surfaces, and in some cases completely incrustation-clogged passages in the storage mass of the heat exchanger while the latter is in the installed state, but after the air preheater has been taken out of operation, and to flush the loosened matter reliably and completely out of the storage mass, rows of nozzles for a high-pressure cleaning agent, and flushing nozzles connected to the cleaning nozzles but designed for a higher liquid throughput but lower pressure, have been provided on a nozzle carriage which is displaced within a sector on appropriate guiding means over the face of the storage mass of the heat exchanger relative to the planes of the heat-exchanging surfaces (DE-B 25 14 173). Furthermore, a system is known for the purpose of releasing loosely adherent, dusty coatings by deep-acting cleaning jets during the operation of the rotary regenerative heat exchanger and driving them out before it is possible for tightly adherent primary coatings and secondary coatings to build up thereon. For this purpose, injector nozzles for injecting a gaseous or vaporous cleaning agent under low to medium pressure are used, which are followed, in the direction of the emerging nozzle stream, by injector pipes such that they aspirate a portion of the gas stream flowing about these nozzles during operation into the tube and feed it, mixed with the cleaning agent, as directed jets at a velocity equalized across the injector cross section to the passages formed between the heat-exchanging surfaces of the storage mass (DE-B 26 15 433). Although the velocity at which the jets from the nozzles enter into the passages between the heat-transfer surfaces to be cleaned is reduced by this aspirating action, the mass flow is nevertheless increased in the same degree and a more intense and deeper releasing and blowing action is achieved.

The machinery used in industry, especially the automotive industry, includes paint and lacquer spraying apparatus. Proposals for the recovery of heat from the exhaust of this lacquer spraying equipment for the purpose of reheating their input air have not produced satisfactory results. The paint fog precipitators which have, on the basis of these proposals, been connected to the heat exchanging apparatus, have not been able, in spite of being improved to ever higher degrees of separation of recently as much as nearly 99.9%, to protect the heat exchangers to the necessary extent. Rotary regenerative heat exchangers used as heat transfer means have in this case proven to be especially endangered, since on account of their design they have particularly narrow passages at the entrance of which residual paint particles are deposited from the exhaust stream, stick together, and soon render the rotary regenerative heat exchanger inoperative. The same applies to other lacquering equipment, for example in the metal apparatus and furniture industry.

It is the object of the invention to create a possibility for the effective cleaning of the heat transfer surfaces of rotary regenerative heat exchangers while the heat exchanging gases are still flowing through them. This must be accomplished within a very short period of time, without markedly increasing the energy requirement, and without greatly stressing the storage mass, so that it will be possible to use these heat exchangers in cases in which impurities are carried by the heat exchanging gases from a preceding process, which have a particular tendency to deposit themselves on the heat transferring surfaces in the form of hardening incrustations and coatings, ultimately resulting in the clogging of the passages between the heat transfer surfaces.

Setting out from an apparatus of the kind described above, this object is achieved according to the invention by the fact that a drive is associated with the rotor of the regenerative heat exchanger, and this drive makes it possible to establish variable rotatory running speeds and lower cleaning speeds, and permits variation of the rotor speeds according to the position of the nozzle carriage between the rotor hub and the rotor circumference, and by the fact that limit switches are provided at the circumference and hub for an interruption or change in direction of the movement of the nozzle carriage. With the apparatus thus configured it is possible to equalize the cleaning action of the nozzle jets across the storage mass within the annular areas on which the nozzles are acting, while the relative velocity between the carriage and the storage mass, which is preferably kept constant, is reduced below the running speed and adapted to the radial distance of the carriage from the hub.

Advantageous for an intensive cleaning action is a further development in which a stepping mechanism is associated with the drive of the nozzle carriage, which advances the nozzle carriage by the diameter of the cone of the spray from the nozzles impacting the storage mass each time that this cone completes at least one circle on the storage mass surface as the rotor revolves.

In a regenerative heat exchanger with a revolving storage mass as rotor and stationary connecting passages, an advantageous play-free advancement of the carriage can be achieved by means of at least one threaded spindle journaled at its extremities on a crossbeam of the housing and/or on parts of the wall of the housing, a spindle nut connected to the nozzle carriage and engaging the threaded spindle which can be motor-driven, and at least one high-pressure hot water or steam cleaning nozzle and/or a compressed-air nozzle.

To minimize the contamination of the heat exchanging gas stream within the passage in which the cleaning is performed, it is recommendable to associate with the cleaning nozzles on the opposite face of the storage mass a catching means for carrying away the cleaning agent together with the impurities dissolved out of the storage mass.

This catching means can be in the form of a trough which is best supported on the housing and aligned parallel with the axis along which the nozzle carriage is guided, and which is of such a length that it extends all the way across the confronting storage mass surface, or else, to minimize the reduction of the passage cross section of the heat exchanging gas stream, it can also be in the form of a funnel moving synchronously with the nozzles, while hoses are provided on the catching means for draining away the cleaning agent charged with the dissolved incrustations.

To prevent the liquid cleaning agent driven into the catching means and the impurities it carries from returning into the surrounding gas stream, lips of flexible material can be disposed on the entrance side of the catching means.

An especially economical use of liquid cleaning agent is achieved if a connecting conduit is provided which is connected to a drain on the catching means and leads into a holding tank, possibly with the insertion of a device for separating entrained impurities.

Repeated re-use of the cleaning agent in circulation is possible if the holding tank is connected by a conduit and a pressure-raising pump to the cleaning agent nozzle or nozzles.

For rotary regenerative heat exchangers which are designed for the transfer of exhaust heat to indoor air—in engine test stands for example—it can be advantageous to use compressed air or steam as the gaseous cleaning agent, i.e., the cleaning nozzles are connected to a compressed-air source or to a steam generator. If an already installed compressed air source is available it will then also be advisable to drive the threaded spindle or spindles by a compressed-air motor rather than the variable-speed electric motor which will otherwise be necessary.

Alternatively, one or more pneumatic cylinders can be connected as linear actuators to the nozzle carriage, and also to the catching means if desired.

The nozzle carriage in that case is preferably displaceable on at least one guiding track in such a manner as to keep it from rotating. This track is preferably in the form of a slotted tube which envelops the spindle or the piston rod of the compressed-air cylinder on the side where the contaminated gas enters, and, in a slot offset toward the entrance side, secures the spindle nut, or the connecting element between the carriage and the spindle nut, or the piston rod, against rotation. Thus the slotted tube serves a double purpose, namely the purpose of guiding the nozzle carriage, on the one hand, and shielding the threaded spindle, or the piston rod of the compressed-air cylinder, against the deposit of the impurities contained in the gas stream.

With the device according to the invention, use is made of a process for the cleaning of rotary regenerative heat exchangers, which is characterized by the fact that the rotatory speed of the revolving part of the regenerative heat exchanger is reduced for the cleaning, jets of a cleaning agent and, if desired, of a drying agent are sprayed onto the storage mass surface with continuous or step-wise radial displacement from the outside in and/or vice-versa, whereby the impurities deposited between the heat transfer surfaces at the entrance to the passages are dissolved by the cleaning agent, effectively and with a uniform action on the surface of the storage mass, and at the same time they are discharged through the passages carrying the heat exchanging gases on the side of the storage mass surface opposite the side on which the contaminated gas and cleaning agent enter it. At the same time it is desirable that the jets then be made to act in steps of about the width of the area where the jets strike the storage mass whenever the revolving part of the regenerative heat exchanger has performed at least one complete revolution.

The speed of rotation of the revolving part of the regenerative heat exchanger is best reduced to a speed between 0.1 and 0.3, especially 0.2 revolutions per minute, so as to achieve a uniform and gentle action on the storage mass surface by the cleaning agent jets.

In regenerative heat exchangers which are designed for the transfer of heat from exhaust air containing paint mist, it is advantageous to use as the liquid cleaning agent high-pressure hot water at a pressure of 60 to 140 bar, preferably 120 bar, and at a temperature of about 60° to 100°, sprayed in jets against the face of the storage mass.

Then the storage mass can be dried by compressed air delivered at a pressure between 3 and 8 bar.

Solvents and/or inhibitors—for the prevention or reduction of corrosion of the metal of the storage mass for example—can be added to the hot water.

To shorten the time required for the cleaning and for the drying operation that may follow, it is recommendable to proceed by first cleaning the storage mass while shifting the cleaning spray jets from the outside in, and then rinsing and/or drying from the inside out by radially shifting the rinsing or drying jets; the cleaning and/or rinsing or drying is then repeated in case of necessity. Alternatively, the sequence can be reversed, or the rinsing and drying jets are made to act immediately following the cleaning spray jets during the same radial displacement.

In cases in which exhaust heat is being transferred to the fresh air being supplied to a room or rooms, a mixture of gaseous or liquid and solid, preferably powdered or granular agents can be used as the cleaning agents.

Figure 2:
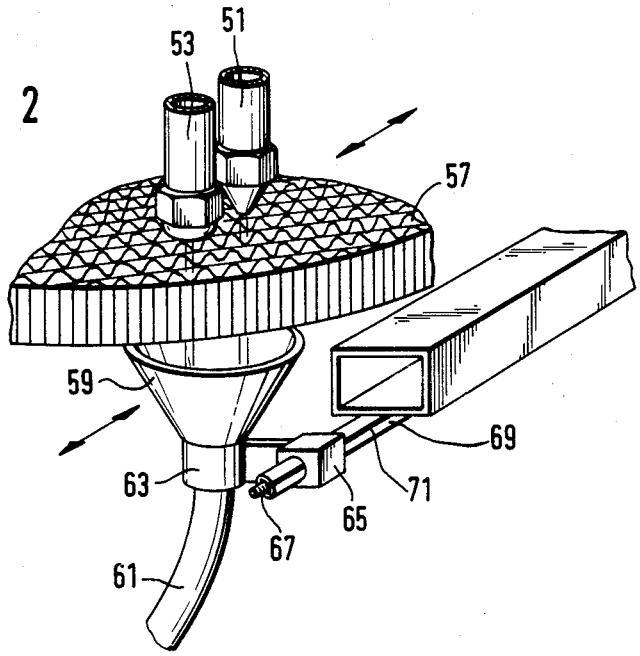

The invention is further explained in the following description of two embodiments, in conjunction with the drawing, wherein:

FIG. 1 is a perspective view of a portion of a device according to the invention, and FIG. 2 is a perspective view of a portion of a variant embodiment of the device according to the invention.

FIG. 1 is a fragmentary representation of a section of a rotary regenerative heat exchanger which has a storage mass 7 driven in rotation, i.e., simultaneously serving as a rotor. A drying nozzle 1 and a cleaning nozzle 3 are fastened on a common carriage 5. The nozzles are represented with respect to the storage mass 7 of the heat exchanger, of which only a section is represented, as being connected radially one behind the other. A duct 11 carries compressed air to the drying nozzle 1, and a pipe 31 makes hot water available to the cleaning nozzle 3 from appropriate sources, which are not represented. On the carriage 5 there is fastened a spindle nut (not shown), through which a threaded spindle 13 passes. The threaded spindle is surrounded by a guiding track in the form of a slotted tube 15. The spindle nut, which is affixed to the nozzle carriage, reaches through the slot of the slotted tube 15. The ends of the spindle are journaled in bearings 17, and a stepping drive 19 is connected to the radially outer end. On the side of the storage mass opposite the arrangement of the carriage as the bearer of the nozzles there is a catching trough 20 which has a drain 22. The entrance of the catching trough is provided with lips 24 and 26 of resilient material turned back at an angle from the direction of entry; these lips are opened by the impact of the jets of cleaning agent and thus prevent the cleaning agent from flowing back out of the catching trough 20 to the storage mass 7.

FIG. 2 shows a modification of the catching means, on a slightly larger scale than FIG. 1, and the fragmentary view is more limited. Of the drying and cleaning nozzles only the nozzle heads 51 and 53 are represented in the drawing. On the side of the storage mass 57 opposite these nozzles there is disposed a funnel-like catching means 59 with a connecting tube 61. This catching means is connected by a funnel holder 63 to a carriage 65 which is coupled by a spindle nut (again not shown) to a threaded spindle 67. The threaded spindle 67 is shielded from the surrounding gas stream by a track element 69, again in the form of a slotted tube, which simultaneously performs the guidance of the carriage, while the longitudinal slot 71 provided in the track element 69 keeps the carriage from turning. The spindle 67 of the catching means is coupled mechanically with the spindle, not shown in FIG. 2, for the movement of the carriage bearing the nozzles 51 and 53 such that the nozzle heads 51 and 53 can be driven on the one side of the storage mass 57 and the catching means 59 can be driven on the other side thereof, radially across the storage mass surfaces facing them, in synchronism with one another, by a common motor.

In the above description, the cleaning device according to the invention has been described in its application to regenerative heat exchangers having a revolving storage mass in the form of a rotor, and accordingly stationary connecting passages for the heat exchanging gas streams. It can also be used for the opposite embodiment of heat exchangers, i.e., heat exchangers with a stationary storage mass and revolving hoods as the gas connections, in which case the nozzles and the catching means rotate together with the revolving hoods over the faces of the storage mass. In the first case, therefore, the storage mass is to be considered as the rotating part of the heat exchanger, i.e., the rotor, and in the second case it is the revolving hoods provided on the entrance and exhaust sides and revolving synchronously that are to be considered as the rotating part or rotor.

We claim:

1. A device for cleaning a rotary regenerative heat exchanger for the transfer of heat from a higher-temperature, contaminated gas stream to a lower-temperature clean gas stream, said heat exchanger having a storage mass and a rotor; said device comprising: a carriage, means for guiding and driving the carriage radially over the storage mass between an outer end position adjacent the circumference of the storage mass and an inner end position adjacent the center of the storage mass, at least one cleaning agent nozzle disposed on said carriage, a conduit for feeding a cleaning agent to said nozzle, at least one nozzle for a drying agent, arranged adjacent said at least one cleaning agent nozzle, a drive associated with the rotor for establishing variable running speeds and lower cleaning speeds and for varying the rotatory speed of the rotor depending on the position of the carriage between the rotor center and the rotor circumference, end switches at the circumference and at the center respectively for interrupting or changing the direction of movement of the carriage, and catching means arranged directly adjacent the storage mass on a side thereof remote from the nozzle, for catching and carrying away the cleaning agent including impurities removed from the storage mass.

2. A device according to claim 1, comprising a stepping mechanism associated with the drive for advancing the carriage stepwise each time by about the diameter of a cone of nozzle jets from said nozzle striking the storage mass as soon as the cone completes at least one circle on the storage mass during the rotation of the rotor.

3. A device according to claim 1, wherein said catching means is a catching trough and is aligned axially parallel to the means for guiding the carriage.

4. A device according to claim 2, comprising lips of flexible material disposed at an entry side of said catching means for preventing escape of the cleaning agent stream charged with impurities from the catching means.

5. A device according to claim 1, comprising a conduit connected to a drain of the catching means for the cleaning agent and leading into a holding tank.

6. A process for cleaning a rotary regenerative heat exchanger for the transfer of heat from a higher-temperature, contaminated gas stream to a lower-temperature clean gas stream, having a rotating part and a storage mass, comprising the steps of: reducing the rotary speed of the rotating part, spraying jets of a cleaning agent and, immediately thereafter jets of a gaseous drying agent, onto the storage mass, with a continuous or stepwise radial displacement of the jets outside in or inside out.

7. A processing according to claim 6, comprising varying the rotatory speed of the rotating part and the position of the cleaning agent jets and drying agent jets such as to keep constant the area of the storage mass struck by the nozzle jets.

8. A process according to claim 6, comprising spraying the storage mass each time the rotating part has performed at least one complete revolution after shifting the jets step-wise by approximately the size of the area of impact of the jets.

9. A process according to claim 6, comprising reducing the rotatory speed of the rotating part to 0.1 to 0.3, revolutions per minute.

10. A process according to claim 6, for the transfer of heat from an exhaust containing paint fog to fresh air of a paint spraying installation, comprising spraying hot water with a pressure of 60 to 140 bar, and a temperature of about 60° to 100° C., against the storage mass.

11. A process according to claim 10, comprising drying the storage mass with compressed air delivered at a pressure between 3 and 8 bar after spraying with the high-pressure hot water.

12. A process according to claim 10, comprising adding a solvent and/or clog inhibitor to the hot water.

13. A process according to claim 6, comprising first spraying the storage mass by radial displacement of the cleaning agent jets from the outside in, and thereafter spraying the storage mass by radial displacement of drying agent jets from the inside out.

14. A process according to claim 6, for the transfer of exhaust gas heat to fresh air, comprising using a mixture of gaseous, or liquid and solid cleaning agents.

* * * * *